United States Patent [19]

Burgin

[11] 4,065,891

[45] Jan. 3, 1978

[54] ROTARY FLOOR GRAIN BIN

[76] Inventor: Kermit H. Burgin, P.O. Box 334, Whitestown, Ind. 46075

[21] Appl. No.: 717,603

[22] Filed: Aug. 26, 1976

Related U.S. Application Data

[63] Continuation of Ser. No. 663,093, March 2, 1976, abandoned.

[51] Int. Cl.[2] ..... E04H 5/08; B61J 1/00; E04B 1/346

[52] U.S. Cl. ..... 52/65; 104/46; 52/197; 295/1

[58] Field of Search ..... 104/35–47; 295/1, 31 R; 16/106, 107; 52/65, 197

[56] References Cited

U.S. PATENT DOCUMENTS

| | | | |
|---|---|---|---|
| 40,123 | 9/1863 | Sharp | 295/1 |
| 56,571 | 7/1866 | Kelly | 104/46 |
| 755,607 | 3/1904 | Bischoff | 16/106 |
| 943,491 | 12/1909 | True | 104/44 |
| 955,382 | 4/1910 | Clark | 295/1 |
| 970,857 | 9/1910 | Smith | 104/46 |
| 1,417,384 | 5/1922 | Imler | 104/44 |
| 1,596,166 | 8/1926 | Everett | 295/31 R |

FOREIGN PATENT DOCUMENTS

| | | | |
|---|---|---|---|
| 984 of | 1863 | United Kingdom | 104/46 |

*Primary Examiner*—James L. Ridgill, Jr.
*Attorney, Agent, or Firm*—Jenkins, Coffey & Hyland

[57] ABSTRACT

A rotary floor comprising a base having an upwardly facing surface and defining a vertically extending center axis, a platform disposed above and in vertical registry with the base, the platform having a bottom side, circular outer and inner lower tracks concentrically mounted on the base, circular outer and inner upper tracks concentrically mounted on the bottom side of the platform to be in vertical registry, respectively, with the lower tracks, and a plurality of wheels disposed between the tracks rotatably to support the platform. The plurality of wheels comprise first wheels running on the outer lower track and under and supporting the outer upper track, and a plurality of second wheels running on the inner lower track and under and supporting the inner upper track. A driver is provided for the platform to rotate it about the axis. The first and second wheels are provided in mated, radially spaced apart pairs, and a radially extending axle is provided having opposite outer and inner ends journal mounting, respectively, the first and second wheels of each pair. The pairs of wheels are peripherally spaced apart and that spacing may be maintained by rigid links extending between the axles.

18 Claims, 11 Drawing Figures

ROTARY FLOOR GRAIN BIN

This application is a continuation of my co-pending U.S. patent application Ser. No. 663,093, filed Mar. 2, 1976, and titled Rotary Floor Grain Bin, now abandoned.

The present invention relates to rotary floors and more particularly to the provision of a rotary floor ideally suited for use in a rotary floor grain bin of the type disclosed in my U.S. Pat. No. 3,766,664 issued Oct. 23, 1973. My U.S. Pat. No. 3,766,664 discloses a grain circulating system including an upstanding bin defining a center vertical axis and a floor which rotates about that axis. Particulate material movers are carried on the floor to be movable therewith, the movers being proportioned and designed to move the material radially inwardly toward the center portion of the floor as the floor rotates. The movers on the floor sweep underneath the material and move it radially inwardly.

Reference is made to my U.S. Pat. No. 3,766,664 and the patent references cited therein. In that earlier patent, I show a floor supported on a plurality of wheel assemblies with the wheel assemblies riding on a concentric, annular track supported upon a base. The rotary floor of my present invention constitutes an improvement upon the floor disclosed in my U.S. Pat. No. 3,766,664 and other rotary floors known to me. The rotary floor of my present invention is much less expensive to construct and much easier to maintain. It is designed to provide easy access to the underneath side of the rotary floor for maintenance purposes. Particularly, in a grain bin application, workmen can easily move past the wheel assemblies to a point underneath the center of the rotary platform to maintain the grain moving apparatus. It will be appreciated that such grain moving apparatus includes augers, chutes and the like which often have to be adjusted and/or repaired.

Reference is also made to Hughes, British Pat. No. 984 of AD 1863. Hughes illustrates a turntable system in which circular inner and outer tracks are provided on the upwardly facing surface of a turntable base. Sets of outer and inner wheels ride on these outer and inner tracks, respectively. Circular spacers are provided on the axles which extend between the outer and inner wheels of each pair. The turntable is supported upon the base for rotation with respect thereto by a plurality of spherical bearings which bear the weight of the turntable. The bearings ride in a groove on one of the two adjacent surfaces of the Hughes turntable. This groove desirably has an elliptical cross-section. The spacers, which are supported and guided upon the circular outer and inner tracks by the outer and inner wheels, respectively, are interposed between each two adjacent spherical bearings to provide substantially equal separation of the bearings about the turntable.

Reference is also made to True U.S. Pat. No. 943,491, Kitson U.S. Pat. No. 935,994, Smith U.S. Pat. No. 970,857 and Hunter et al U.S. Pat. No. 913,388. All of these patents relating to turntables disclose centering supports or axles attached to spiders. The spiders are mounted pivotally on the central vertical axles of the rotary floors of these devices. The spaces beneath the centers of such floors thus are occupied by apparatus for rotatably supporting the prior-art floors.

It is an object of the present invention to provide a rotary floor arrangement which provides a work space beneath the center of the floor.

Another object of my invention is to provide a rotary floor comprising a base having an upwardly facing surface and defining a vertically extending center axis, a platform disposed above the base and having a downwardly facing surface, in which the improvement comprises lower track means concentrically mounted on the upwardly facing surface, upper track means concentrically mounted on the downwardly facing surface, and wheel means riding on the lower track means and under and supporting the upper track means, thereby mounting the platform for rotation about the axis. Means for driving the platform about the axis is provided and may take several different forms. It will be appreciated that the wheel means are not journal mounted upon brackets which are attached either to the base or to the platform. The wheel means, in fact, function as roller bearings between the upper and lower track means, rotatably supporting the platform.

In the illustrated embodiments, the invention comprises circular outer and inner lower tracks concentrically mounted on the base, circular outer and inner upper tracks concentrically mounted on the bottom side of the platform to be in vertical registry, respectively, with the lower tracks, a plurality of first wheels running on the outer lower track and under and supporting the outer upper track, and a plurality of second wheels running on the inner lower track and under and supporting the inner upper track. These first and second wheels are provided in mated, radially spaced apart pairs, and a radially extending axle having opposite outer and inner ends journal mounting, respectively, the first and second wheels of each pair is provided. Further, means is provided for spacing these axles peripherally about the tracks. The spacing means may take different forms and may include, for instance, rigid links having opposite ends connected, respectively, to adjacent axles.

In one embodiment of the present invention, the base is divided into a plurality of base sections having upper surfaces lying generally in a common plane and defining the first said upwardly facing base surface, the base sections being spaced radially outwardly from and peripherally about the center axis of the base to provide a maintenance work space beneath the center of the platform as well as generally radially extending passages for access to the work space. The lower tracks bridge across these passages.

Other objects and features of the present invention will become apparent as this description progresses.

In the drawings:

FIG. 6 is a view similar to FIG. 1 showing a different type of rotary floor arrangement and, particularly, a different type of support base for such a rotary floor arrangement, while

Figure 8:
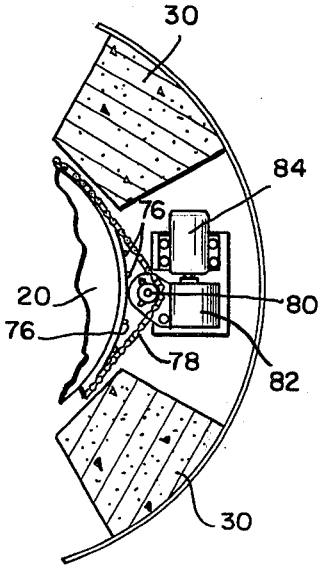
FIG. 8 is a fragmentary, partially sectioned plan view showing one possible drive for the rotary floor.

Reference is made to the specification of my earlier U.S. Pat. No. 3,766,664 which may supply structural details pertinent to the grain drying technique accommodated by the rotary floor. Referring particularly to the drawings of the present invention, like reference numerals representing like parts, the illustrative bin 10 is shown having a circular side wall 12 formed about a center axis 14 with a lower wall portion 16 of the bin being concentrically conically shaped to funnel grain inwardly and downwardly. The lower, peripherally extending edge 18 of the lower portion 16 is adjacent to top surface of the floor 20 and particularly the outer peripheral edge 48 portion of the floor. This floor 20, which rotates about the axis 14 as will be described, is perforated or at least portions of the floor are perforated as best seen in FIG. 8 so that air can move therethrough. Grain moving vanes 22 are mounted upon the rotary floor 20 to draw the grain radially inwardly to the center of the floor so that it may drop through a center opening 20a to fall through a chute **20*b* or alternatively to be drawn upwardly through an auger 20*c***. Such chutes and augers are discussed in U.S. Pat. No. 3,766,664.

The reference numeral 24 represents generally means for rotatably supporting the floor 20 for rotation about the axis 14 on the base 26 which is formed to provide an upwardly facing surface 28. Peripherally and radially spaced apart pedestals 30 having upper surfaces 32 support the conical wall portion 16 as discussed in U.S. Pat. No. 3,766,664.

Figure 1:
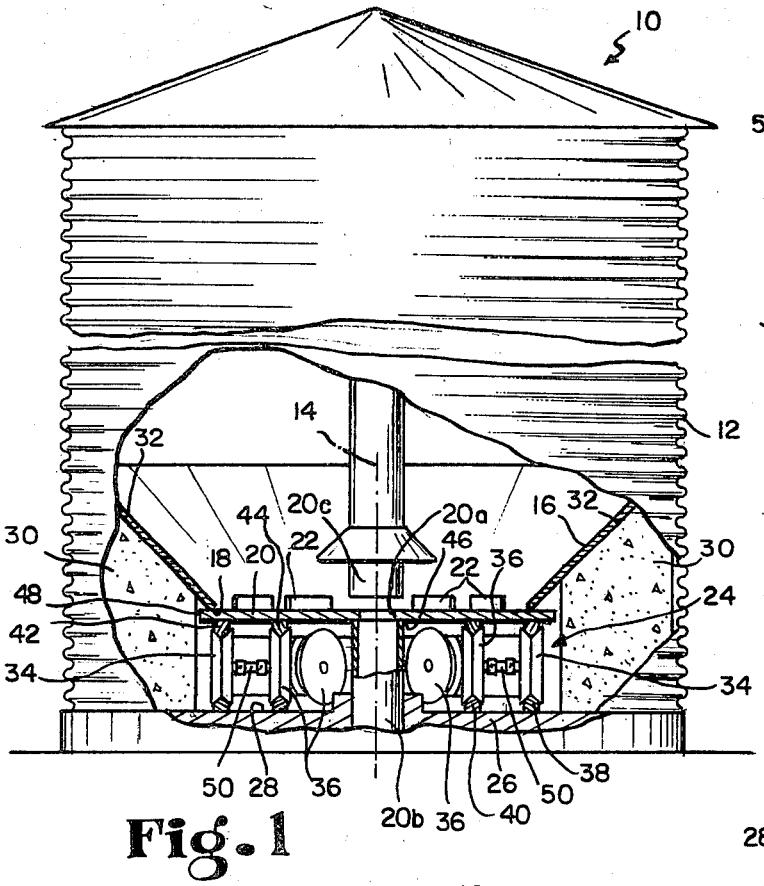
FIG. 1 is an elevation view, partially cut away and partially sectioned, of a bin including the rotary floor of the present invention.
Figure 3:
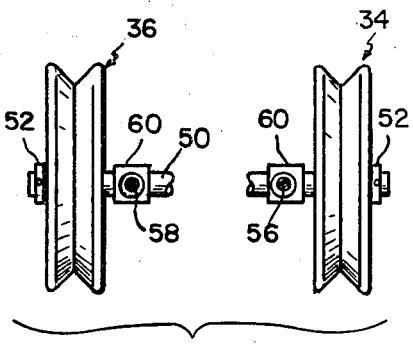
FIG. 3 is a fragmentary view of the wheels.
Figure 4:
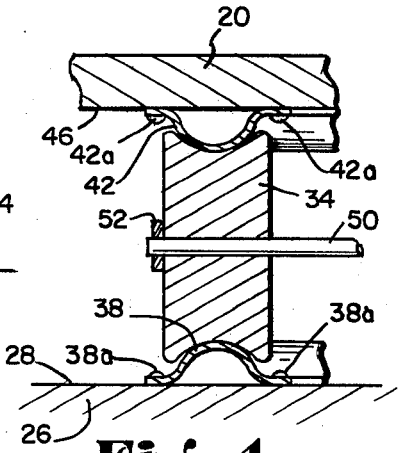
FIG. 4 is a fragmentary sectional view of a different type of wheel and a different type of track.

The rotary support means 24 includes a plurality of first wheels 34 and a plurality of second wheels 36, the first and second wheels, respectively, riding upon outer and inner tracks concentrically mounted upon the upper surface 28 of the base 26. Above the lower tracks 38, 40 are outer and inner upper tracks 42, 44 mounted concentrically upon the bottom side 46 of the platform 20. The wheels 34, 36 ride under and support, respectively, the tracks 42, 44. Generally speaking, the wheels 34, 36 function in much the same manner as ball bearings do in a rotary bearing. The FIG. 1 illustrative tracks 38, 40, 42, 44 have a generally V-shaped radial cross-section and the illustrative wheels 34, 36 are shaped to accommodate such a cross-section. It will be appreciated, however, that several other different types of tracks and wheel cross-sections may be used in the present invention, two different arrangements being shown in FIGS. 4 and 5. In the arrangement of FIG. 4, the wheel 34 is shown having a rather shallow groove for engaging and riding upon and under formed metal tracks 38, 42. The lower track 38 is shown fastened to the base 26 by fastening elements 38a while the upper track 42 is shown fastened to the platform 20 by fastening elements 42a.

Figure 5:
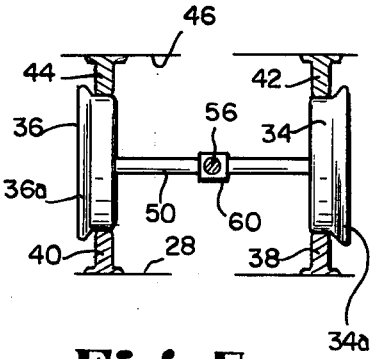
FIG. 5 is a fragmentary view of still another different type of wheel and track arrangement.

The illustrative structure of FIG. 5 has wheels 34, 36 with outer flanges on one side only. The wheel 36 has such a flange **36*a* on its inner side while the wheel 34 has such a flange 34*a*** on its outer side.

Figure 2:
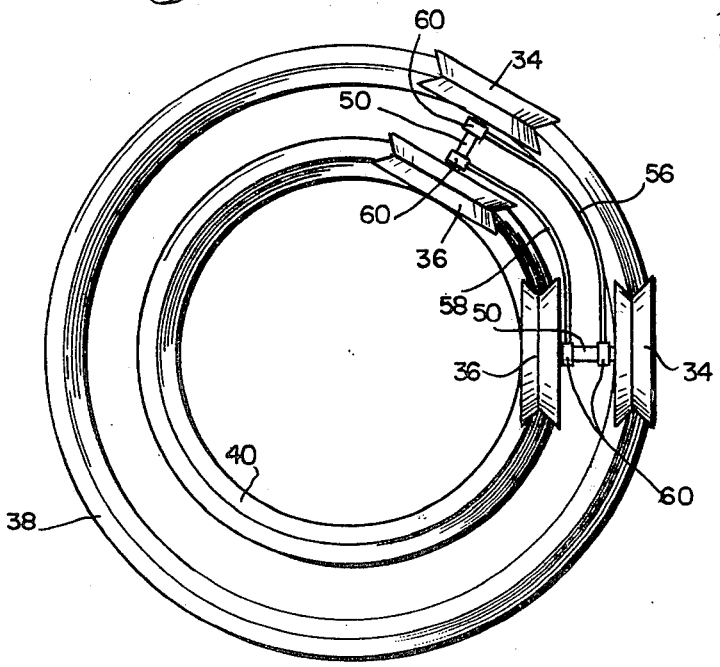
FIG. 2 is a plan view looking down on the lower tracks.

In the illustrative and preferred embodiments, the wheels 34, 36 are provided in radially spaced apart pairs and an axle 50 is provided for each pair, the axle having its opposite ends journal mounted in the wheel bearings. Retainers 52 are desirably provided to secure the axles against radial movement relative to the wheels. The axles are provided for the purpose of keeping the wheels 34, 36 moving in pairs, to serve as means for providing peripheral spacing between adjacent wheels 34, 36 and to keep the wheels upright. One or more rigid links 56, 58 may extend between adjacent axles 50, each link having an axle connector 60 at its opposite ends. In the embodiment of FIGS. 1 and 2, two such links 56, 58 are provided while in the embodiment of FIGS. 6 and 7 only one such link 56 is provided.

Figure 7:
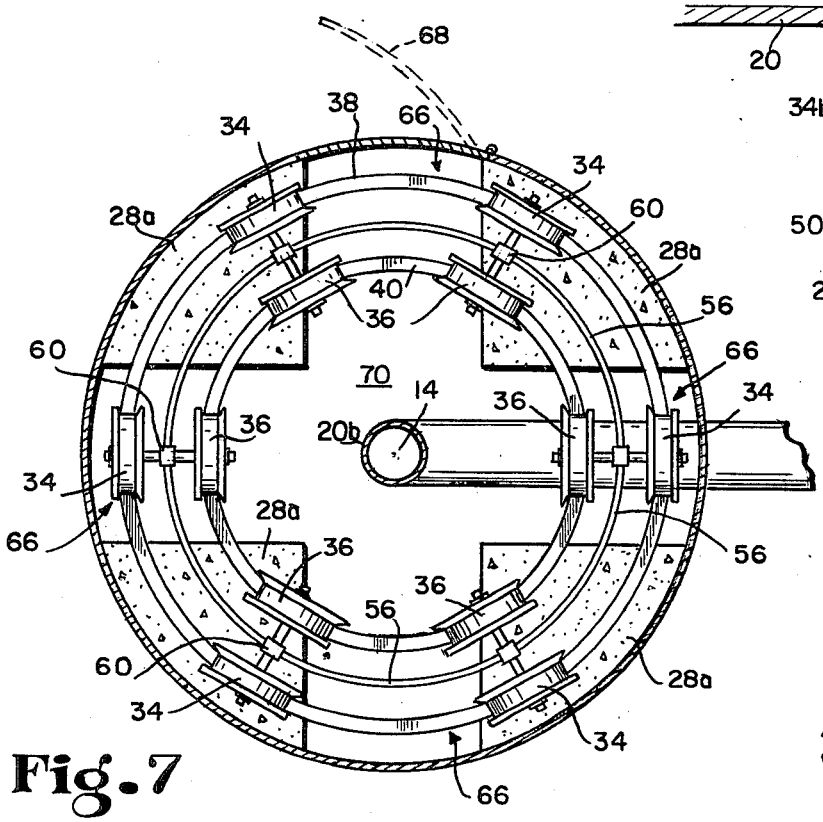
FIG. 7 is a plan view looking down on the support base, wheels and lower tracks shown in FIG. 6.
Figure 6A:
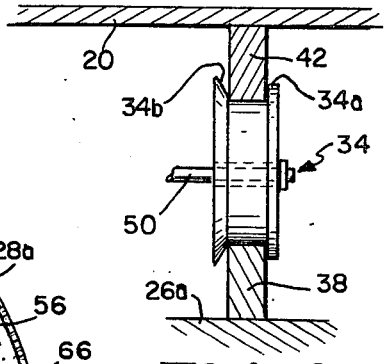
FIG. 6a is a view of the wheels and tracks of the FIG. 6 embodiment.
Figure 6:
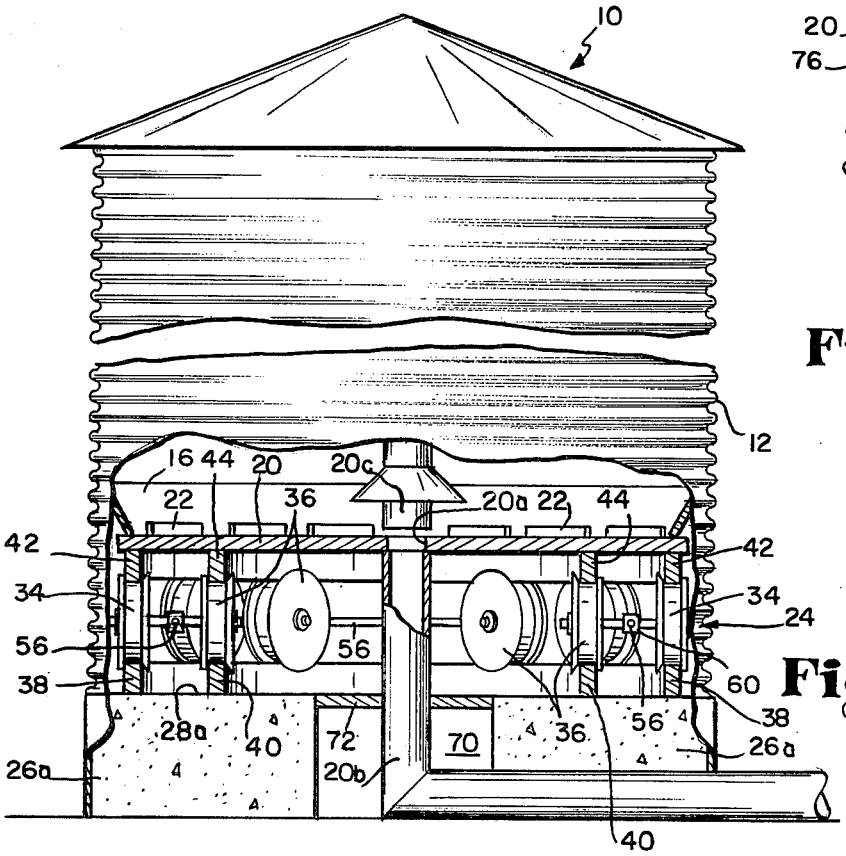

In the embodiment of FIGS. 6 and 7, the pedestals 30 are not used, and the conical wall 16 is quite shallow as illustrated. The base 26 is divided into four peripherally and radially spaced apart quarter sections **26*a*, the upper surfaces 28*a* of which lie in a common horizontal plane to support the outer and inner lower tracks 38, 40. These base sections 26*a* are peripherally spaced apart to provide access passages 66 to the center area of the bin beneath the platform 20. Each passage may be provided with an access door such as indicated at 68. The base sections 26*a* are spaced radially outwardly from the center axis 14 to provide a maintenance work space 70 beneath the center portion of the platform 20. The tracks, 38, 40 will bridge across these passages 66, and support bridges such as indicated at 72 in FIG. 6** may be provided for supporting those portions of the tracks not resting directly upon a base section.

Several different types of drives may be used to rotate the floors 20, one type of drive being shown in FIG. 8. The floor 20 in FIG. 8 is shown having a plurality of sprocket teeth 76 extending outwardly therefrom, and a chain 78 is trained about the floor and about a drive sprocket 80 which is on the output shaft of a gear box 82 which is, in turn, driven by a motor 84.

FIG. 6a shows a preferred wheel and track structure, each track 38, 40, 42, 44 having a generally rectangular cross-section and each wheel having an outer periphery designed to accommodate the track cross-section. The radially outer side of each wheel 34, 36 has a peripherally and radially extending rim edge **34*a* while the radially inner side has peripherally extending inclined flange 34*b*** to prevent binding against the tracks.

Figure 9:
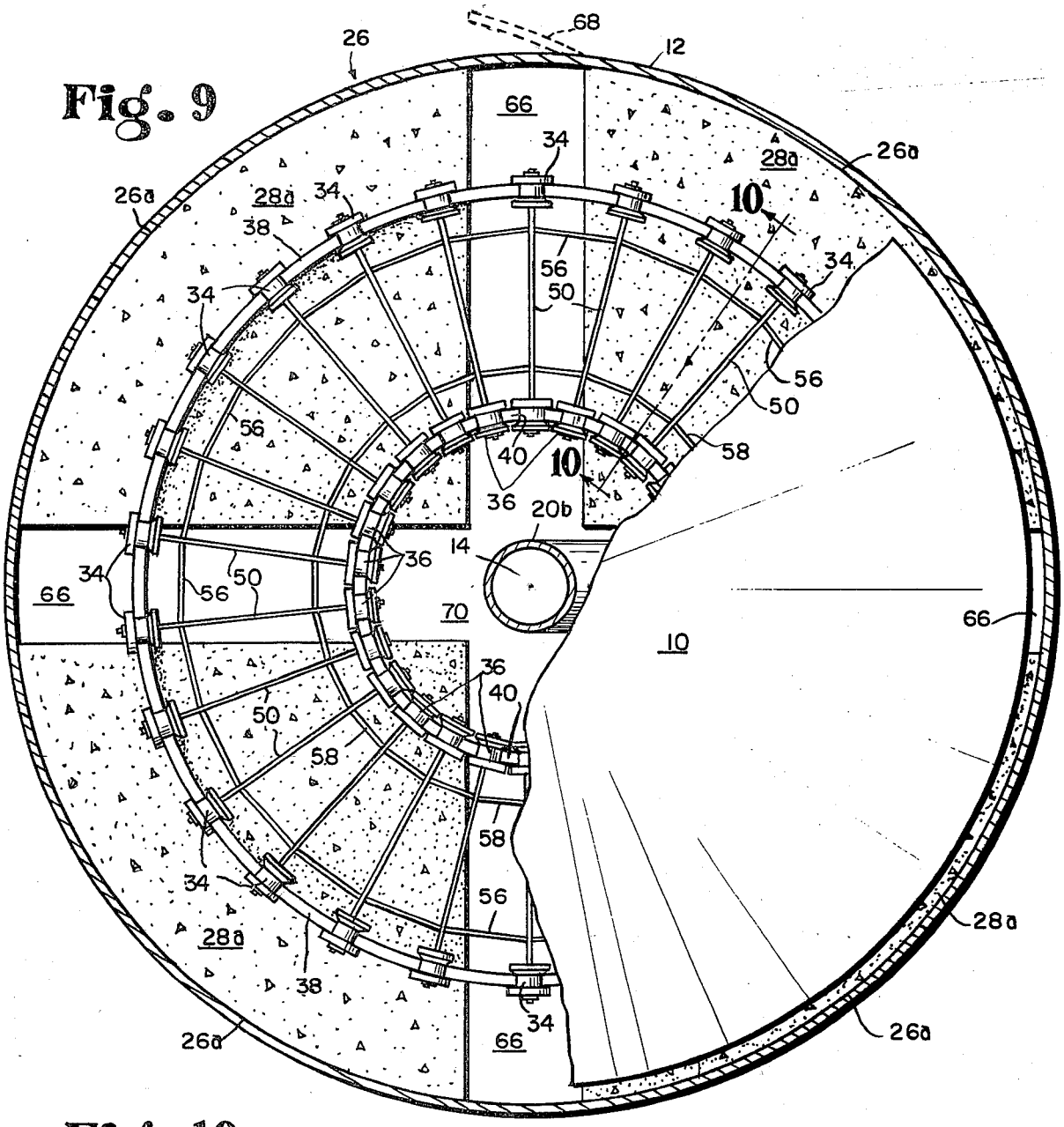
FIG. 9 is a plan view looking down on the support base, wheels and lower tracks of another embodiment of the rotary floor of the present invention; and, FIG. 10 is a fragmentary sectional view of the embodiment of FIG. 9, taken along section lines 10—10 thereof.
Figure 10:
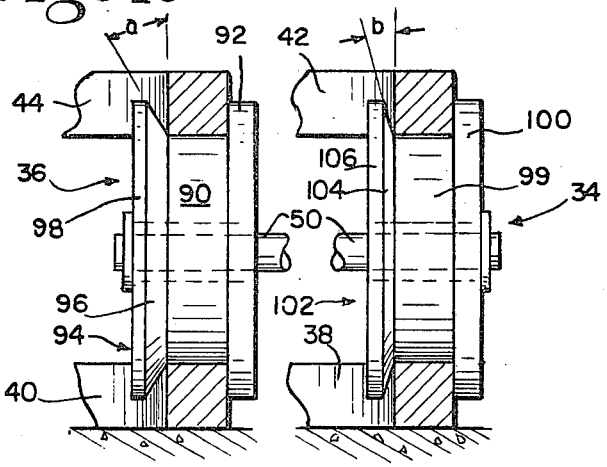

In the embodiment of FIGS. 9 and 10, as in the embodiment of FIGS. 6 and 7, the base 26 is divided into four peripherally and radially spaced apart quarter sections **26*a*, the upper surfaces 28*a* of which lie in a common horizontal plane to support the outer and inner lower tracks 38, 40. Base sections 26*a* are peripherally spaced apart to provide access passages 66 beneath the bin. Each passage may be provided with an access door such as indicated at 68. Base sections 26*a* are radially spaced outwardly from the center axis 14 of the base and platform and provide a maintenance space 70 beneath the center of the platform (not shown). Tracks 38, 40 bridge across passages 66, and support bridges (not shown) may be provided to support those portions of the tracks not resting upon base sections 26*a***.

Each of outer and inner wheels 34, 36 is journal mounted for rotation on a radially outer or inner end, respectively, of one of axles 50. As before, the axles serve to maintain the radial spacing between the outer and inner wheels 34, 36 of each pair. Axles 50 also maintain the vertical orientation of the outer and inner wheels between the outer and inner tracks of each pair of tracks. The axles 50, for instance, may be $\frac{1}{8}$ inch smaller in diameter than the center holes of the wheels 34, 36 through which they extend.

Means comprising a plurality of straight coupling links 56, 58 couple the axles 50 of each adjacent pair of wheels 34, 36 to one another. Coupling links 56, 58 maintain the peripheral spacing of the axles. Links 56 are coupled between adjacent axles 50 adjacent the outer wheels 34 of such axles. Links 58 are coupled between adjacent axles 50 adjacent the inner wheels 36 of such axles.

Referring to FIG. 10, the inner wheels 36 comprise central cylindrical portions 90 positioned between the lower inner track 40 and the upper inner track 44. Wheels 36 further comprise radially outer flanges 92 and radially inner flanges 94. Each outer flange 92 has a generally rectangular cross-section. Each inner flange 94 includes an inclined portion 96. Inclined portions 96 prevent binding of inner wheels 36 between the inner tracks 40, 44. Inclined portions 96 thus make an angle *a* with the inner side walls of tracks 40, 44. Radially inner flange 94 also includes a portion 98 radially inwardly along axle 50 from portion 96. Portion 98 has a generally rectangular cross-section.

Each of outer wheels 34 is similarly constructed. Each outer wheel 34 includes a central cylindrical portion 99 positioned between the outer tracks 38, 42 of the first and second pairs of tracks, respectively. Each outer wheel 34 also includes an outer flange 100, which has a generally rectangular cross-section, and an inner flange 102. Inner flange 102 comprises a sloping portion 104 and a portion 106. Portion 104 makes an angle *b* with the inner side walls of tracks 38, 42. Portion 106 has a generally rectangular cross-section.

In an apparatus constructed as illustrated in FIGS. 9 and 10, the diameter of the base 26 and platform (not shown) is 18 feet. The diameter of the outer tracks 38, 42 is 14 feet. The diameter of the inner tracks 40, 44 is 6 feet. Twenty-six sets of wheels 34, 36 on axles 50 are provided. Each outer wheel 34 has a flange 100 with a diameter of 5-¼ inches, a central portion 99 diameter of 4 inches, and a flange portion 106 diameter of 5-¼ inches. The width of flange 100 is ½ inch. The width of central portion 99 is 1 inch. The width of flange portion 106 is 11/32 inch. The angle *b* is approximately 14°. For inner wheels 36, the diameters of outer flange 92 and inner flange portion 98 are 5-¼ inches. The diameter of central portion 90 is 4 inches. The width of flange 92 is ½ inch. The width of inner flange portion 98 is ⅛ inch. The angle *a* is approximately 31°.

It will be appreciated that flanges 92, 94, 100 and 102 on wheels 34, 36 resist shifting of the platform on the base when force is applied to turn the platform on the base. The wheel configurations of FIGS. 6*a* and 10 have been found to be particularly advantageous in this regard.

What is claimed is:

1. A rotary floor comprising a base having an upwardly facing surface and defining a vertically extending center axis, a platform disposed above and in vertical registry with said base, said platform having a bottom side, in which the improvement comprises circular outer and inner lower tracks concentrically mounted on said base, circular outer and inner upper tracks concentrically mounted on said bottom side to be in vertical registry, respectively, with said lower tracks, a plurality of first wheels running on said outer lower track and under and supporting said outer upper track, a plurality of second wheels running on said inner lower track and under and supporting said inner upper track, means for driving said platform about said axis, each said first wheel being mated with one of said second wheels and spaced radially outwardly therefrom, and an axle for each mated first and second wheel, said mated wheels being rotatably mounted on said axle.

2. The improvement of claim 1 including means for spacing said wheels peripherally about said tracks, said spacing means including means extending between adjacent axles.

3. The improvement of claim 2 including a plurality of rigid links for spacing said mated wheels peripherally about said tracks, each link having a forward end and a trailing end, means for connecting the forward end of each link to one of said axles and means for connecting the trailing end of each link to the next adjacent axle.

4. The improvement of claim 2 and further including means for spacing said axles peripherally about said tracks.

5. The improvement of claim 4 in which said spacing means includes, extending between adjacent axles, rigid links having opposite ends connected respectively to the adjacent axles.

6. A rotary floor comprising a base having an upwardly facing surface and defining a vertically extending center axis, a platform disposed above and in vertical registry with said base, said platform having a bottom side, in which the improvement comprises circular outer and inner lower tracks concentrically mounted on said base, circular outer and inner upper tracks concentrically mounted on said bottom side to be in vertical registry, respectively, with said lower tracks, a plurality of first wheels running on said outer lower track and under and supporting said outer upper track, a plurality of second wheels running on said inner lower track and under and supporting said inner upper track, and means for driving said platform about said axis, said first and second wheels being provided in mated, radially spaced apart pairs, a radially extending axle having opposite outer and inner ends rotatably mounting, respectively, the first and second wheels of each pair, and means for spacing said axles peripherally about said tracks, said spacing means including, extending between adjacent axles, a pair of rigid links, one of said links being an outer link adjacent said first wheels and the other of said links being an inner link adjacent said second wheels.

7. A rotary floor comprising a base having an upwardly facing surface and defining a vertically extending center axis, a platform disposed above and in vertical registry with said base, said platform having a bottom side, in which the improvement comprises circular outer and inner lower tracks concentrically mounted on said base, circular outer and inner upper tracks concentrically mounted on said bottom side to be in vertical registry, respectively, with said lower tracks, a plurality of first wheels running on said outer lower track and under and supporting said outer upper track, a plurality of second wheels running on said inner lower track and under and supporting said inner upper track, and means for driving said platform about said axis, said base being divided into a plurality of base sections having upper surfaces defining said first mentioned upwardly facing surface, said base sections being spaced radially outwardly from and peripherally about said center axis to provide a maintenance work space beneath the center of said platform and generally radially extending passages for access to said space, said lower tracks bridging over said passages.

8. A rotary floor comprising a base for providing an upwardly facing supporting surface, a platform for providing a downwardly facing supporting surface, the upwardly and downwardly facing supporting surfaces being in vertical registry and having a common central axis, a first pair of concentric inner and outer tracks mounted on the upwardly facing supporting surface, a second pair of concentric inner and outer tracks mounted on the downwardly facing supporting surface in registry with the inner and outer tracks, respectively, of the first pair, a plurality of pairs of wheels for movably supporting the platform on the base, each pair of wheels including an inner wheel positioned vertically between the inner tracks, the means for coupling the axles of each adjacent pair of wheels to one another comprising link means fixedly connected to adjacent axles to maintain peripheral spacing of the axles, the link means including an inner link connected to adjacent axles adjacent the inner wheels of such adjacent axles and an outer link connected to adjacent axles adjacent the outer wheels of such adjacent axles.

9. A rotary floor comprising a base having an upwardly facing surface and defining a vertically extending center axis, a platform disposed above said base and having a downwardly facing surface, lower track means concentrically mounted on said upwardly facing surface, upper track means concentrically mounted on said downwardly facing surface, and wheel means riding on said lower track means and under and supporting said upper track means, thereby mounting said platform for rotation about said axis, and means for driving said platform about said axis, said base being divided into a plurality of peripherally spaced apart radial base sections having generally radially and peripherally extending access spaces therebetween, said sections having upwardly facing surface areas lying generally in a common plane to define said first mentioned upwardly facing surface, said lower track means bridging across said access spaces.

10. The invention of claim 9 in which said base sections are spaced radially outwardly from said center axis to provide a maintenance work space beneath the center of said platform.

11. In combination, a storage bin and a rotary floor therefor, the rotary floor comprising a base for providing an upwardly facing supporting surface, a platform for providing a downwardly facing supporting surface, the upwardly and downwardly facing supporting surfaces being in vertical registry and having a common central axis, a first pair of concentric inner and outer tracks mounted on the upwardly facing supporting surface, a second pair of concentric inner and outer tracks mounted on the downwardly facing supporting surface in registry with the inner and outer tracks, respectively, of the first pair, a plurality of pairs of wheels for movably supporting the platform on the base, each pair of wheels including an inner wheel positioned vertically between the inner tracks and an outer wheel positioned vertically between the outer tracks, an axle for joining the inner and outer wheels of each pair, the axles extending radially outwardly of the common central axis, means for coupling the axles of adjacent pairs of wheels to one another to maintain peripheral spacing of adjacent pairs of wheels, and means for rotating the platform about the common central axis.

12. The invention of claim 11 wherein each of the inner and outer wheels of each pair of wheels comprises a central portion for positioning between the outer tracks of the first and second pairs, and inner and outer flanges for maintaining the wheel central portion between the tracks, the outer flange comprising a portion having a generally rectangular cross-section, the inner flange comprising an inclined portion for preventing binding of the outer wheel between the tracks, the inclined portion sloping from a maximum diameter at a radially inner portion of the flange to the central portion diameter at a radially outer portion of the flange, and the inner flange further comprising a portion having a generally rectangular cross-section located radially inwardly from the inclined portion.

13. The invention of claim 12 wherein the base is divided into a plurality of base sections, each section having an upper surface, the upper surfaces of the base secions defining the upwardly facing supporting surface, the base sections being spaced radially outwardly from and peripherally about the common central axis to provide a maintenance space beneath the center of the platform and generally radially extending passages for access to the space, the tracks of the first pair bridging across the space.

14. The invention of claim 12 wherein the inner and outer wheels of each pair are journal mounted for rotation on the radially inner and outer ends, respectively, of their respective axle, the axles serving to maintain the radial spacing between the inner and outer wheels of each pair and the vertical orientation of the inner and outer wheels of each pair between the inner and outer tracks, respectively, of each pair of tracks.

15. The invention of claim 12 wherein the means for coupling the axles of each adjacent pair of wheels to one another comprises link means fixedly connected to adjacent axles to maintain peripheral spacing of the axles.

16. A rotary floor comprising a base for providing an upwardly facing supporting surface, a platform for providing a downwardly facing supporting surface, the upwardly and downwardly facing supporting surfaces being in vertical registry and having a common central axis, a first pair of concentric inner and outer tracks mounted on the upwardly facing supporting surface, a second pair of concentric inner and outer tracks mounted on the downwardly facing supporting surface in registry with the inner and outer tracks, respectively, of the first pair, a plurality of pairs of wheels for movably supporting the platform on the base, each pair of wheels including an inner wheel positioned vertically between the inner tracks and an outer wheel positioned vertically between the outer tracks, an axle for joining the inner and outer wheels of each pair, the axles extending radially outwardly of the common central axis, means for coupling the axles of adjacent pairs of wheels to one another to maintain peripheral spacing of adjacent pairs of wheels, and means for rotating the platform about the common central axis, the inner and outer wheels of each pair of wheels comprising a central portion for positioning between the inner tracks of the first and second pairs, and inner and outer flanges for maintaining the wheel central portion between the tracks, the outer flange including a portion having a generally rectangular cross section.

17. the invention of claim 16 wherein the inner flange comprises an inclined portion for preventing binding of the inner wheel between the tracks, the inclined portion sloping from a maximum diameter at a radially inner portion of the flange to the central portion diameter at a radially outer portion of the flange.

18. The invention of claim 17 wherein the inner flange further comprises a portion having a generally rectangular cross-section located radially inwardly from the inclined portion.

* * * * *